US006910301B2

(12) United States Patent
Kalempa et al.

(10) Patent No.: US 6,910,301 B2
(45) Date of Patent: Jun. 28, 2005

(54) SEAL FOR A BI-PARTING DOOR

(75) Inventors: Walenty Kalempa, Slinger, WI (US); Brian Norbert Drifka, Pewaukee, WI (US)

(73) Assignee: Rytec Corporation, Jackson, WI (US)

( * ) Notice: Subject to any disclaimer, the term of this patent is extended or adjusted under 35 U.S.C. 154(b) by 637 days.

(21) Appl. No.: 10/039,381

(22) Filed: Jan. 3, 2002

(65) Prior Publication Data

US 2002/0056236 A1 May 16, 2002
US 2004/0231244 A2 May 16, 2002

Related U.S. Application Data

(63) Continuation of application No. 09/333,732, filed on Jun. 15, 1999.
(60) Provisional application No. 60/090,487, filed on Jun. 24, 1998.

(51) Int. Cl.[7] ..... E06B 7/16
(52) U.S. Cl. ..... 49/368; 49/370; 49/367
(58) Field of Search ..... 49/366, 367, 368, 49/369, 370, 483.1, 475.1

(56) References Cited

U.S. PATENT DOCUMENTS 4,226,489 A * 10/1980 Haag ..... 49/478.1
4,304,071 A * 12/1981 Obrecht ..... 49/370
5,148,631 A * 9/1992 Bayard et al. ..... 49/370
6,330,763 B1 * 12/2001 Kern et al. ..... 49/370

FOREIGN PATENT DOCUMENTS

CH 196048 2/1938

* cited by examiner

*Primary Examiner*—Jerry Redman
(74) *Attorney, Agent, or Firm*—Wallenstein Wagner & Rockey, Ltd.

(57) ABSTRACT

A door seal for use with a bi-parting door in which the door panels of the door have supplementary angled leading edges. One leading edge has a triangular cross-section, while the other has a cross-section similar to a parallelogram. To further the reliability of the door seal, a plurality of magnets with corresponding magnet attracting plates may be attached along the leading edges. Alternatively, both leading edges may have at least one magnet aligned with a magnet on the other edge. With the double magnet configuration, the use of multi-pole magnets is necessary. The magnets also help reduce the bounce between the door panels, which may be closed roughly, and increase the force required to separate the door panels when closed.

17 Claims, 7 Drawing Sheets

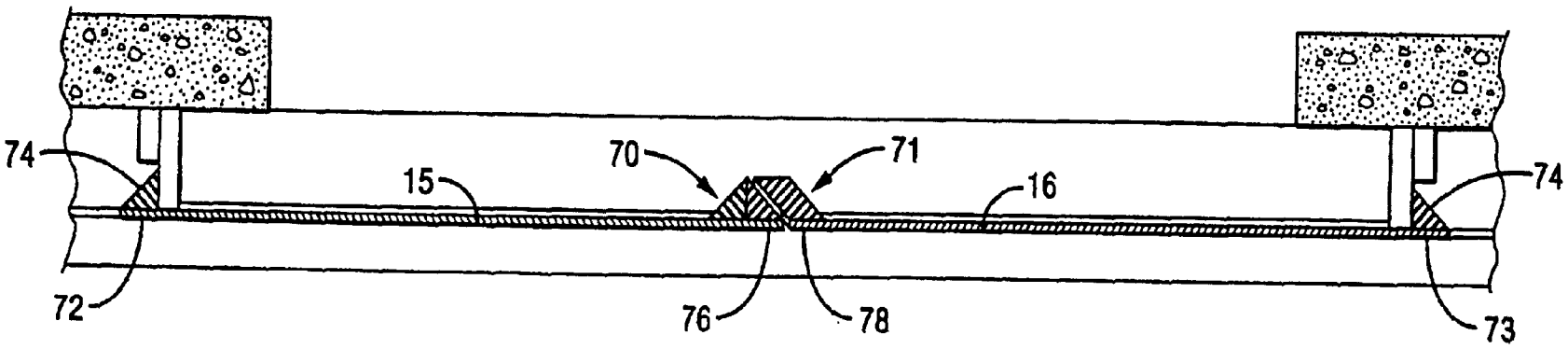
FIG. 7
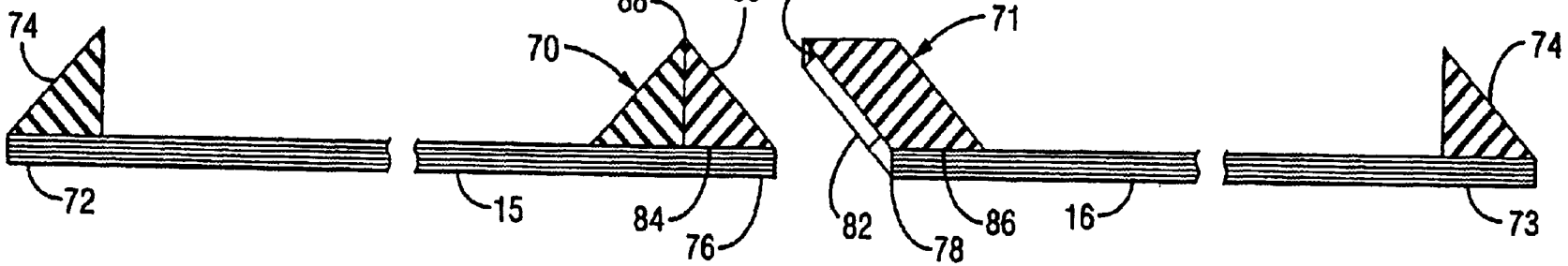
FIG. 8
FIG. 9

SEAL FOR A BI-PARTING DOOR

RELATED APPLICATIONS

This is a continuation application of U.S. patent application Ser. No. 09/333,732, filed Jun. 15, 1999, now abandoned, which claims the benefit of U.S. Provisional Application No. 60/090,487, filed Jun. 24, 1998.

DESCRIPTION

1. Technical Field

The present invention relates generally to automatic sliding doors, and more particularly, to automatic, bi-parting, sliding doors.

2. Background of the Invention

Others have developed track systems and drive systems which operate together to open and close single panel and double panel sliding doors. For example, U.S. Pat. No. 1,054,376 to Weidrich discloses a sliding door hanger and track. In Weidrich a rotating wheel, similar to a pulley, rides along a track with the door being suspended from the axle of the wheel. The door can be slid manually along the track from an opened to a closed position, and vice versa. Subsequent to Weidrich, U.S. Pat. No. 4,344,206 to Hermanson discloses a channel track system which supports a sliding door from the axle of two transversely mounted wheels. Other examples of this "track and wheel" configuration are shown in U.S. Pat. Nos. 4,619,075 to Wiles; U.S. Pat. No. 4,651,469 to Ngian et al; U.S. Pat. No. 4,680,828 to Cook et al.; U.S. Pat. No. 4,770,224 to Dubbelman; and U.S. Pat. No. 4,819,743 to Rousselot et al.

Others have also developed particular drive systems—systems to control the speed, direction and safety of sliding. For example, U.S. Pat. No. 5,247,763 to Hein discloses a conventional system using a motor, drive belt, and various pulleys to open and close double paneled sliding doors. Typically, the travel and direction within conventional systems is controlled by limit switches, sensor devices, or the like, mounted at some point in exposed areas, such as on a face of the door or within the travel path of the door itself. Many have timed actuation, engaging the drive motor at a specific speed and for a specific period—which, of course, is preset to correspond to the desired distance of travel for the door. However, exterior mounted sensors are highly susceptible to damage, particularly when used in industrial settings, and sometimes the exterior sensors present an undesirable aesthetic concern for other applications.

An area which has not received much attention in this field is the door panel seal. In the use of bi-parting doors, either sliding or folding, it is often desirable to achieve a good closure between the panels. Too often this necessity has been ignored at the expense of lost heat or cold, or noise abatement. The present invention has broken from these accepted practices to produce a novel sliding door system.

The present invention has achieved a more reliable, more durable, and more cost effective system for opening and closing sliding doors, such as those used for warehouses, cold storage, freezers, and the like. Additionally, once closed, the door according to the present invention provides a uniquely effective door panel seal to keep separate the environments on opposite sides of the door. The present invention further discloses a unique bracket assembly which brings many of its other advanced features into a compatible relationship.

These and other advantages are provided by the present invention.

SUMMARY OF THE INVENTION

The present invention discloses an automatic sliding door assembly having a unique bracket assembly, track system, sensor assembly, and door panel seal.

In general terms, the invention is an effective, essentially trouble-free door seal to help separate the environments on each side of the door. The present invention provides a door seal for use with bi-parting doors, comprising at least one magnet along the leading edge of a first door panel, and at least one magnet attracting plate attached to the leading edge of a second door panel. The magnet and magnet attracting plate abut when the panels are in a closed position.

More specifically, according to one embodiment of the present invention, a door seal is disclosed for use with bi-parting doors comprising a first door panel having a leading edge which recedes at an angle to the plane of the first door panel, and a second door panel having a leading edge which projects at an angle to the plane of the second door panel. To form a proper seal the angle of the leading edge of the first door panel is supplementary to the angle of the leading edge of the second door panel.

According to one embodiment of the present invention, the respective leading edges of the first and second door panels are supported by a solid material. The solid material in the first door panel preferably has a triangular cross-section, while the solid material in the second door panel has a cross-section substantially similar to a parallelogram.

It is further in accordance with the present invention that a face of the leading edge of at least one of the door panels should have at least one magnet, while a face of the other leading edge has at least one magnet attracting plate. Accordingly, in order to provide a proper seal between the door panels, the magnet and magnet attracting plate are aligned in pairs.

These and other objects and advantages will be made apparent from the following discussion of a preferred embodiment of the invention and the referenced drawings, as well as the appended claims.

BRIEF DESCRIPTION OF THE DRAWINGS

In the drawings:

FIG. 7 is a top cross-sectional view of the door of FIG. 1, taken along line 7—7 of FIG 1;

FIG. 8 is an elevated cross-section of the left door panel of FIG. 1;

FIG. 9 is an elevated cross-section of the right door panel of FIG. 1;

DETAILED DESCRIPTION OF A PREFERRED EMBODIMENT

Figure 1:
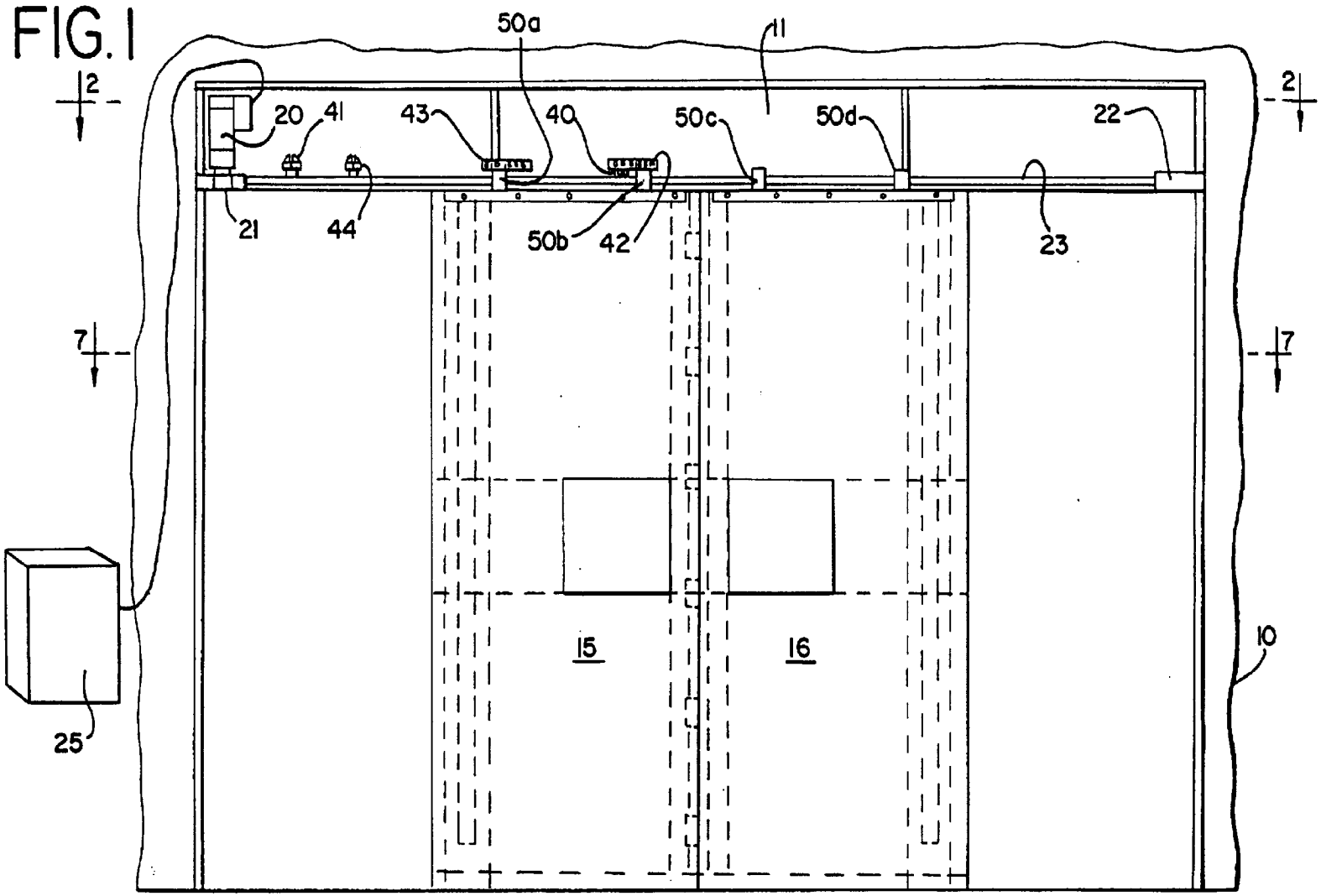
FIG. 1 is a front view of a door assembly constructed in accordance with the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows an automatic bi-parting sliding door system of the present invention, generally designated with the reference numeral 10, installed about an opening. "Opening" generally refers to any passage or through-way defined in a general manner by one or more wall edges or other frame-like structures. A header compartment 11 (shown in FIG. 2) is used to house drive assembly 12, horizontal track assembly 13, and sensor system 14. The drive assembly 12 mounted in compartment 11 has a drive motor 20, a drive pulley 21 connected to a drive shaft of motor 20, an idler pulley 22 adjustably mounted at the opposing end of header compartment 11 from the motor 20, and a drive belt 23 wrapped around drive pulley 21 and idler pulley 22. The drive assembly 12 is controlled by a controller 25. The controller 25 is responsive to the sensor system 14. The track assembly 13 is comprised of a horizontal track 30, and a number of linear bearings 33, each within a protective housing 32. The sensor system 14 has three sensors (first, second, and third) 40,41, and 44, respectively (one of which is shown in greater detail in FIG. 4), responsive to a pair of sensor plates (first and second) 42, 43. Each sensor is uniquely spaced and used for determining a proper time for slowing or stopping the sliding doors.

The bi-parting door system, shown in FIG. 1, also has two sliding door panels (first and second) 15, 16 which are suspended from track 30 and carried by linear bearings 33 to allow travel across the doorway opening. Door panels 15, 16 may be designed in a variety of sizes from any number of materials, depending on the application. Each door panel 15, 16 should be approximately equal to one-half the width of the opening, and of a height approximately equal to the opening height. With a single sliding door (not shown), the door panel is preferably of the same approximate height and width of the opening. However, where certain applications may require, it is contemplated by the present invention that the cumulative size of all door panels in a single application could be significantly less than, or significantly more than the size of the opening. Furthermore, the use of greater than two door panels (not shown) is also contemplated, and the modification of the presently disclosed invention to accommodate such design variations would naturally be readily understood by those skilled in the art after studying this disclosure, without requiring undue experimentation. All remaining discussions will be directed to a bi-parting sliding door design, but it is understood that such discussion will also be applicable to bi-parting folding doors and the particular design variations mentioned.

Track Assembly

Referring still to FIG. 1, the header compartment 11 can be more readily understood. Header compartment 11 is, in the present embodiment, centered above the door opening and is used for concealing and protecting the mounting of various components of the sliding door system 10. It is preferable that header compartment 11 span at least approximately twice the width of the opening to allow each door panel 15, 16 to clear the opening when retracted. With this configuration, approximately one-quarter of the length of header compartment 11 will extend beyond each side of the opening. For aesthetics and protection of the various components, the header compartment 11 may be completely enclosed by a metal or plastic housing, if desired. Additionally, if space allows, header compartment 11 may be recessed within the wall containing the opening.

Figure 2:
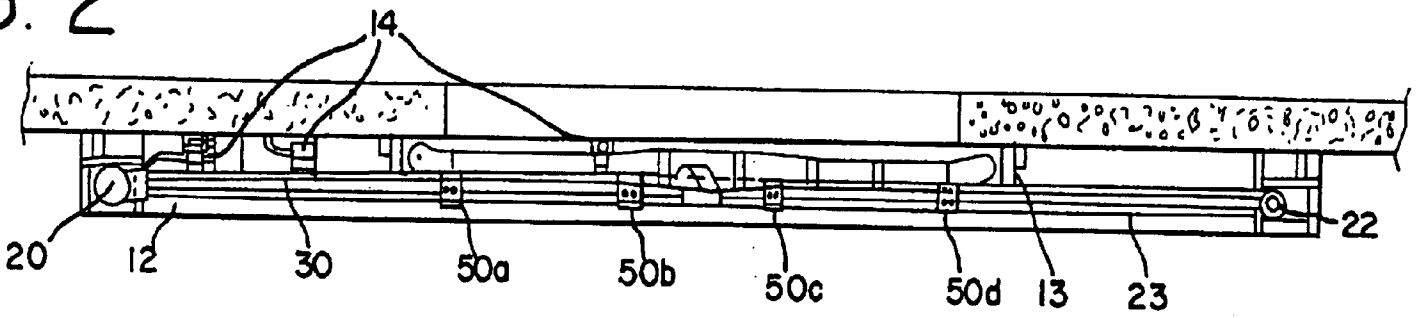
FIG. 2 is top cross-section of the door of FIG. I taken along line 2—2 of FIG. 1.

The track assembly 13, as shown in FIG. 2, allows the door panels 15, 16 to move horizontally between the opened and closed positions. Track 30 is preferably two sections of one inch (1") polished steel rods aligned linearly, and centered and mounted above the opening. For the present invention, this material provides sufficient weight bearing strength, as well as an economic advantage. Of course, other materials of various sizes and cross-sections may be used to the extent they achieve the desired results in accordance with any of the broad objects of the present invention. Such alternative designs include an "I" beam track, a channel track, a flat track, or even square, oval, triangular, or other shaped cross-sections. Each of these configurations should allow for the linear, non-rolling motion of the linear bearings 33.

Figure 3:
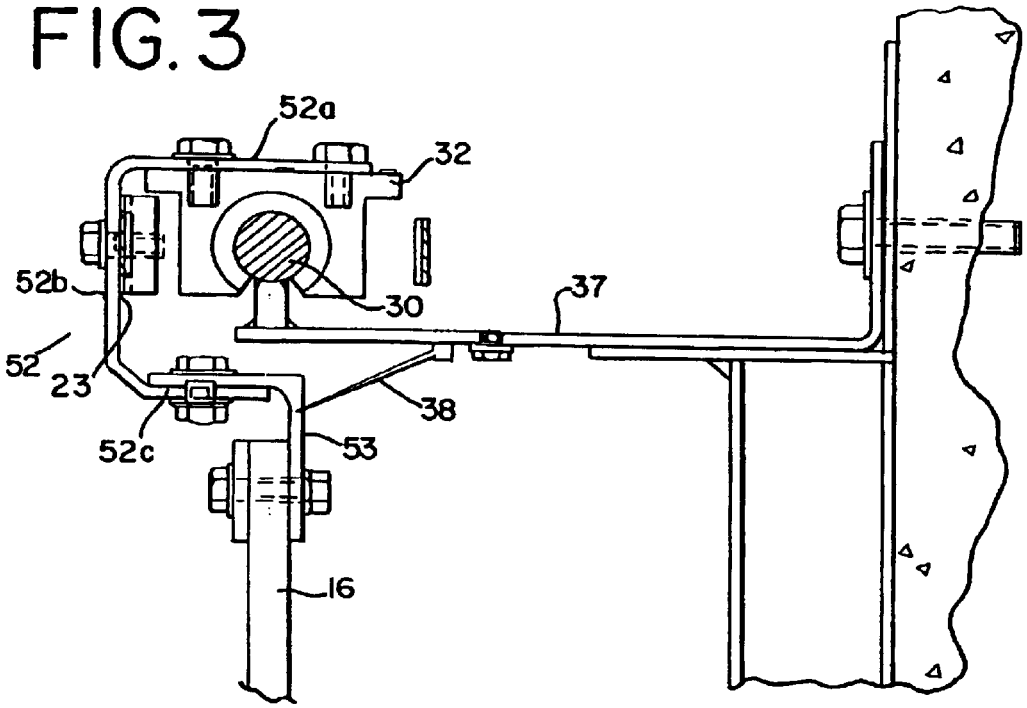
FIG. 3 is an elevated cut-away view of one embodiment of the right door panel bracket assembly and track assembly.

Track 30 is preferably mounted above the opening, or at least proximate to its upper area, using support rail 36 and main support 37. Weld mounting of the track 30 to the support rail 36, and then the support rail 36 to the main support 37, and then mounting the entire structure above the opening gives the upright orientation of track assembly 13 as shown in FIG. 3. Alternative orientations (not shown) may be used, such as an upside down or horizontal orientation, but may reduce the load capacity of the bearing 33 or track assembly 13. It is believed that because a larger area of load bearing contact is achieved along the bearing surface when in the upright orientation, the load capacity is also larger than the alternative orientations.

Additionally, vertical support columns (not shown) braced against the ground surface may be used along each side of the opening to provide greater support to the main support 37. The means by which the track 30, support rail 36, and main support 37 are to be mounted above the opening are too numerous to mention, and such knowledge is well within the understanding of a person skilled in the art.

In the present embodiment, gap 35 may be defined between the two adjacent ends of the rods to allow for future maintenance of the bearing assemblies 31. The gap 35 should be at least slightly greater than the length of a bearing assembly 31 to allow it to be slid off. The usefulness of the gap 35 is more evident in the discussion below related to the linear bearings 33.

Contacting a surface of each of the one inch horizontal rods (track 30) will be a surface of linear bearings 33. In the present invention SIMPLICITY™ Bearings made by the Pacific Bearing Company are used. These linear bearings have an outer surface made from TEFLON™ with other undisclosed fillers to form a material called FRELON™ or its successor FRELON GOLD™. These two materials create a bearing surface which is self-lubricating, chemically inert, capable of high load capacity and strength, and has a low coefficient of friction (0.30 avg. for Frelon™ and 0.125 avg. for Frelon Gold™) and an operating temperature range of about −400° to about 500° F. (−240° to 260° C.). If a lubricant is used, SLICKPAC™ Break-in & Cleaning Oil from the Pacific Bearing Company is preferred (fluorocarbon or silicone oils, grease, spray or WD40™ are not recommended). Naturally, several other suitable liquid and solid materials having low coefficients of friction are available and may be used in the same or similar manner as described below.

Figure 5:
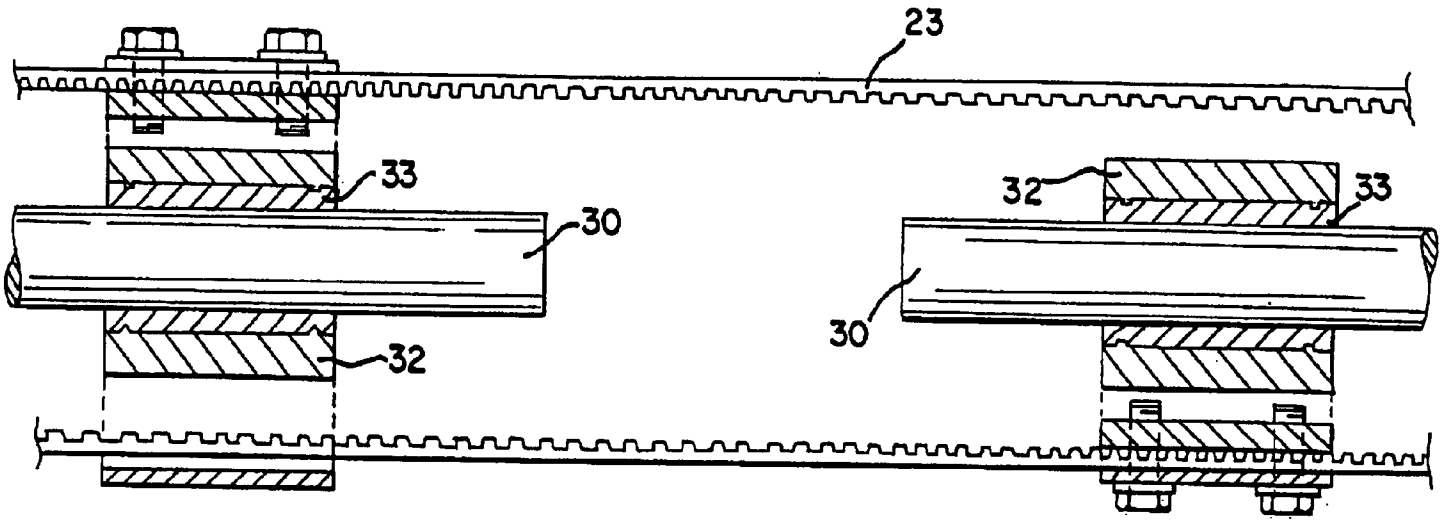
FIG. 5 is a top cross-sectional view taken along line 5—5 of FIG. 4.

In the present embodiment, the low friction material is the contacting layer of the linear bearing 33 as illustrated in the cut-away view of FIG. 5. However, it is contemplated that such material may be applied to the guide track 30. The object is only to provide a linear bearing surface which allows sliding movement between the two contacting surfaces. Regardless of the surface to which the low friction material is applied, track 30, bearing 33, or both during sliding contact between the surfaces, the material will eventually coat both surfaces. This is advantageous because it reduces the sliding friction between the surfaces even greater.

Figure 4:
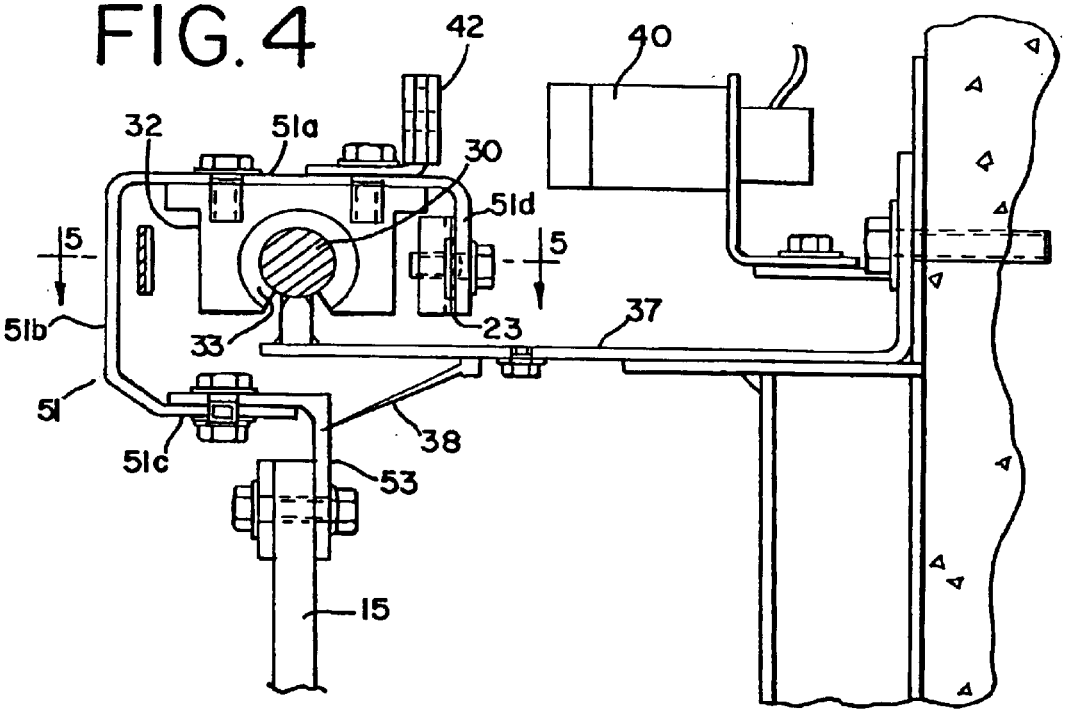
FIG. 4 is an elevated cut-away view of one embodiment of the left door panel bracket assembly and track assembly.

Linear bearings 33 have a "C" cross-section, and are mounted within a block bearing housing 32, as shown in FIGS. 3 and 4. The bearing housing 32 is designed to encase bearing 33 and provide a flat surface for application of a load, such as provided with the attachment of the door panels 15, 16.

Bracket Assemblies

Attachment of each door panel is accomplished via a left and right bracket assembly 50, having a main bracket 51 (left panel), 52 (right panel) and a coupling bracket 53. With smaller and lighter doors, one bracket assembly may be sufficient. Conversely, for larger or heavier doors, more than two bracket assemblies may be needed. The brackets used in the present invention are preferably seven gauge (7 ga.) polished sheet metal with a 0.0002 thick zinc plate.

The main bracket 51, shown in the present embodiment for the left door panel 15, is slightly different than the main bracket 52 (used on right door panel 16), as can be seen by contrasting FIG. 4 with FIG. 3. The reason for the different structure has to do with the use of a continuous belt automatic drive system in the bi-parting doors. Doors which are opened manually, have a single door, or use a drive system having other than a continuous belt may use identical bracket assemblies and still fall within the scope and spirit of the present invention.

In regards to the left panel 15 of the present embodiment, the left and right bracket assemblies 50*a* and 50*b*, respectively, have distinct purposes although identical appearances. The left and right bracket assemblies 50*c* and 50*d* of the right panel 16 are not distinguishable in purpose or appearance. Therefore, the structural discussion of the brackets of right door panel 16 will include the left and right bracket for that panel. Similarly, the structural discussion of the brackets of left door panel 15 will include both the left and right brackets. However, distinction will be made of the left and right brackets for the left door panel 15 when discussing the operation of each.

Right door panel main bracket 52 is attached by an interior surface of a first face 52*a* to the flat surface of bearing housing 32 using bolts. A second face 52*b* of main bracket 52 extends initially at a 90° angle from first face 52*a*, and has an optional angled section (toward first face 52*a*) at a distil end of the second face 52*b*. A third face 52*c* extends from the distil end of second face 52*b* parallel to first face 52*a*. Attached at third face 52*c* on an interior surface, via bolting in the present embodiment, is coupling bracket 53. Coupling bracket is shown having two flanges configured in an upside-down "L" cross-section with one flange bolted to the third face 52*c* of main bracket 52, and the other flange bolted directly to right door panel 16. For proper balance, the extended vertical center line of door panel 16 passes through the center of track 30.

Left door panel main bracket 51 is identically configured as right main bracket 52 explained above, with the addition of a fourth face 51*d* adjacent a first face 51*a*. Fourth face 51*d* is preferably parallel to second face 51*b*, and forms an approximately 90° angle with first face 51*a*. Third face 51*c* is still bolted to a coupling bracket 53, which in turn is bolted to left door panel 15. The attachment position of coupling bracket 53 with respect to all brackets is approximately ten inches from the corresponding panel edge, in the present embodiment.

An optional seal 38, as shown in FIGS. 3 and 4, may be attached to the underside of main support 37 (or any other sufficient surface) to cover the gap between coupling bracket 53 and main support 37. A brush seal is effective for preventing dirt, dust, and other debris from entering the small gap, but other materials known and used by those skilled in the art would be contemplated by the present invention. The seal used, however, should be flexible and resilient to allow for a slight swing in door panels 15, 16. By "swing" it is meant that where the door panels are not secured at their lower edge by a base track, the lower edge may travel in a path perpendicular to the sliding path of the panels. Such "swing" may be as much as 45° or more off center, in either direction. This is desirable in warehouses where impact to the door panels by boxes, pallets, forklifts, and the like would otherwise be very damaging to the panels.

Drive System

While the system thus described is capable of operation by manually sliding door panels 15, 16 along track 30, the present preferred embodiment utilizes a motorized means for sliding the panels. The motorized means includes drive motor 30 and any components necessary for transferring the rotational motion of motor 30 to the linear motion required for sliding the door panels 15, 16 along track 30. In one embodiment, referring to FIG. 1 again, drive motor 30 can be seen positioned at one end of header compartment 11. Naturally, motor 30 can be mounted anywhere it is capable of opening and closing door panels 15, 16. For translating the rotational motion, the present embodiment was a drive pulley 21 connected to the drive shaft of motor 20 and an idler pulley 22 positioned on the opposite end of header compartment 11. Drive belt 23 is preferably continuous and is wrapped around both pulleys. Idler pulley 22 is adjustable to increase or decrease the tension of drive belt 23.

FIG. 4 shows an interior surface of the fourth face 51*d* of main bracket 51 bolted to the backside of drive belt 23. FIG. 3 shows an interior surface of the second face 52*b* of main bracket 52 bolted to the frontside of drive belt 23. When drive motor 20 operates in any direction the two sides of the drive belt loop travel in opposite directions. This causes the bi-parting door panels 15, 16 to move in opposite directions as well.

Figure 6:
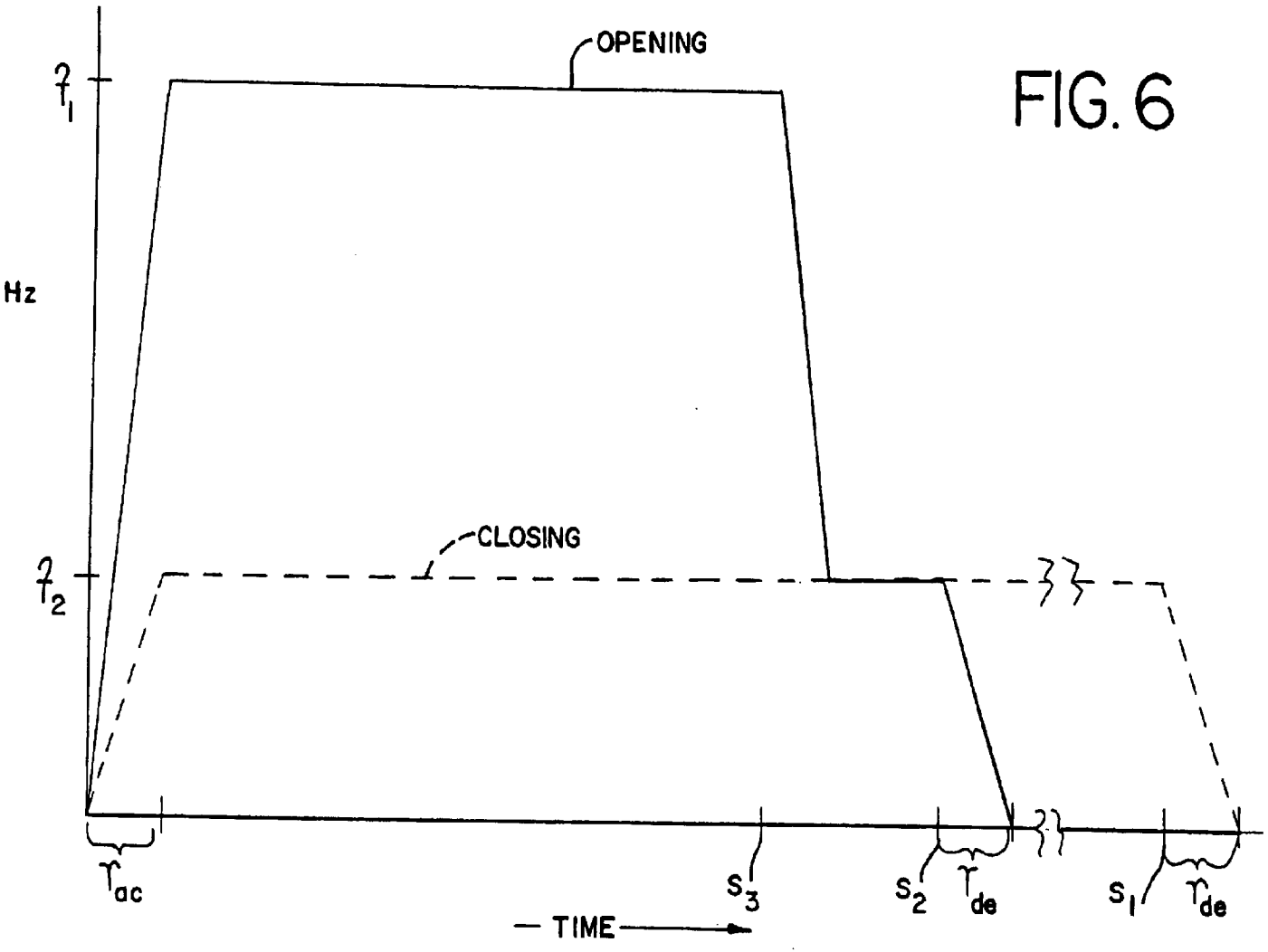
FIG. 6 is a diagram illustrating the preset speeds and ramp time of the opening and closing operation of the door of FIG. 1.

The present preferred embodiment utilizes a SEW-Eurodrive MOVIMOT® drive motor made by SEW-Eurodrive in Lyman, S.C. This particular drive motor is capable of bi-directional, two-speed operation with pre-programmed setpoints. Referring to FIG. 6, these setpoints include two for controlling speed ($F_1$ and $F_2$), and one for controlling ramp time (r). "Ramp time" is the amount of time used to decelerate ($r_{de}$,) and accelerate ($r_{ac}$) between stopped and a preset speed. In the present embodiment the opening speed of the door panels is set at approximately 75

Hz for the first speed ($F_1$), and the second speed ($F_2$) is set at 25 Hz for closing the door panels. For safety purposes, the closing speed is much slower than the initial opening speed. However, with the presets of the motor used in the present embodiment, a variety of first and second speeds are available in any number of combinations. The ramp time is set to 0.2 seconds. FIG. 6 shows a diagrammatic illustration of the opening (solid lines) and closing (broken lines) operation of drive motor 20.

Working in unison with the drive assembly 12, and track assembly 13 is sensor system 14, which can be more readily understood from FIG. 2. The sensor system is hardwired to controller 25 to control the speed, direction, and braking of drive motor 20. In the present embodiment, the sensor system 14 is coupled to the operation of left panel 15, particularly the bracket assembly 50*a* and 50*b* of this panel. Naturally, it is understood that either or both door panels may be effectively utilized with the sensor system 14. Use of such a sensor system 14 in the header compartment 11 is advantageous because it is hidden from view, therefore relieving aesthetic concerns, and it is removed from potential impact by passing traffic, therefore lasting longer and operating more reliably.

In the present embodiment, a first sensor 40 is mounted within header compartment 11 at a point proximate to the stopping point of the leading edge of door panel 15 when in a closed position. The sensors disclosed herein may be any conventional type sensor capable of sending a signal to controller 25 upon the sensing of a predetermined condition. Such sensors include, but are not limited to photo eyes, induction sensors, magnetic proximity sensors, and the like. The proper use and exact placement of these sensors will need to be determined by considering several variables known to those skilled in the art, including the placement of the bracket assembly 50*a* and 50*b* on door panel 15, speed of travel of the panels during closing and opening, sensitivity of the sensor, and the type of sensor used. Each of the sensors in a preferred embodiment is capable of operation in a "detect mode" and a "break mode." In the "detect mode," operation is maintained until a predetermined condition, such as a metal strip passing near a magnetic proximity sensor, is achieved, thereby sending a signal to the controller 25. In the "break mode," operation is maintained as long as the predetermined condition exists. As soon as the predetermined condition ceases to exist, a "break" will occur and a signal will be sent to the controller 25. The detect mode or break mode of either operation is suitable for the present invention.

The following discussion on the operation of one embodiment of the present invention is limited to left door panel 15 and the attached left and right bracket assemblies 50*a* and 50*b*, respectively.

A first sensor plate 42 (FIG. 1) is attached to an exterior surface of the first face 51*a* (FIG. 4) of a right main bracket 51. The sensor plate should, of course, be complementary to the type of sensor used. In the present embodiment, the first sensor 40 is a magnetic sensor and the first sensor plate 42 is an approximately eight inch (8") long strip of approximately 0.13 inch thick and 1.25 inch wide metal. The first sensor plate 42, as shown in FIG. 4, is attached via an angled bracket to the exterior surface of the first face 51*a* of the right main bracket 51. First sensor 40 is mounted via another bracket to the mounting flange of main support 37, also shown in FIG. 4. In the present embodiment, first sensor 40 is positioned approximately eighteen inches (18") off center (i.e., toward left door panel 15) of the opening in the header compartment 11, and is aligned vertically with the first sensor plate 42 as it is mounted on the right main bracket 51.

Similarly, second sensor 41 (FIG. 1) and second sensor plate 43 (FIG. 1) are aligned and mounted at the opposite end of header compartment 11. That is, second sensor plate 43, which is identical to first sensor plate 42 but may be longer for increased dependability purposes, is attached via an angled bracket to the exterior surface of the first face of the left main bracket, and second sensor 41, also magnetic, is positioned approximately eighteen inches (18") from the end of travel of door panel 15 when in an opened position. A third sensor 44 (FIG. 1) is placed between first sensor 40 and second sensor 41 and aligned vertically with second sensor plate 43 (FIG. 1).

During automatic operation of the sliding door assembly 10 from a closed position, any number of signaling devices may be used, as is widely known in the art, to start the motor 20. Such devices include hardwired or cordless pushbutton transmitters, motion detectors, photo eyes, or the like. Referring to FIG. 6, the opening speed of 75 Hz (preset) is achieved after a 0.2 second preset ramp up ($r_{ac}$ of FIG. 6). As the right main bracket 51 of the left door panel 15 nears the third sensor 44, the second sensor plate 43 is magnetically detected (point "$S_3$" of FIG. 6). The third sensor responds with a signal to the controller 25 which responds by stepping the motor speed down to the second preset speed of 25 Hz. The door panels 15, 16 continue opening at this speed until the second sensor plate 43 is magnetically detected by the second sensor 41 (point "$S_2$" of FIG. 6). Sensor 41 responds by sending a signal to the controller 25 which activates the 0.2 second ramp down ($r_{de}$ of FIG. 6) of motor 20. The door assembly 10 is then stopped in a fully opened position.

Once the door is activated again to close, by any of the means mentioned previously, the motor 20 reverses from its previous direction and begins the 0.2 second ramp up ($r_{ac}$ of FIG. 6) to a closing speed of 25 Hz. This closing speed is maintained until the first sensor plate 42 is magnetically detected by first sensor 40 (point "$S_1$" of FIG. 6). Upon detection, first sensor 40 sends a signal to controller 25 which responds by stepping the motor into the 0.2 second ramp down ($r_{de}$ of FIG. 6). The door assembly 10 is now stopped in a fully closed position.

Door Seal

The final aspect of the present invention relates to the door seal created when the panels 15, 16 are brought to a closed position. It should be highlighted that this aspect of the present invention, though discussed and illustrated in terms of sliding doors, is equally applicable to bi-parting folding doors. These types of doors are well known in the art and application of the following discussion to folding doors will be readily understood by those skilled in the art.

Each door panel has a seal 70 (left panel) and 71 (right panel) disposed proximate the leading edge 76, 78 of the respective door panel 15, 16, as shown in FIG. 7. Each door panel also has a trailing edge 72 (left panel) and 73 (right panel). The seals 70, 71 respectively define first sealing and second surfaces 80, 81. In the present invention, the mating geometry between first seal 70 and second seal 71 permits an abutting force when the doors close. The geometry also provides some overlapping extent when the door panels 15, 16 are closed. By maintaining first sealing surface 80 of the first seal 70 at an angle, relative to the plane of the door panel 15, which is supplementary to the angle formed by the second sealing surface 81 of the second seal 71, relative to the plane of door panel 16, the frequency of proper abutment of these edges is increased.

In the present embodiment, as shown in FIG. 8 the first sealing surface 80 of the first seal 70 of left panel 15 recedes at an angle, while the sealing surface 81 of the second seal 71 of right panel 16 projects at an angle (FIG. 9). This configuration is unique in that as the two seals 70, 71 abut, two horizontal force components are exhibited by the edges against one another. The first component is parallel to a plane defined by the surface of the door panels, and is in the direction of travel of the door. That is, each seal 70, 71 will abut the other with a force approximately equal to and opposite from that force of the other. The second force component is approximately perpendicular to the same plane defined by the door panels. The resulting net force is such that the seals 70, 71 will be brought into alignment with one another without substantial bouncing against one another.

The seals 70 and 71 are maintained in their proper configuration by the use of a generally solid material, such as panel foam. FIG. 8 shows the first seal 70 in cross-section as it is supported and maintained in the receded position by a triangular appendage. Thus, the first sealing surface 80 is interposed between the point at which the seal 70 is attached 84 and a distal end 88 of the seal 70 is defined by the apex of the triangle. Similarly, FIG. 9 shows the second seal 71 in cross-section supported and maintained by an appendage substantially similar to a parallelogram. Thus, the second sealing surface 81 is interposed between the point seal 71 is attached 86 and a distal end 90 of the seal 71 is defined by the furthest point of the parallelogram. It is contemplated that other supporting shapes may be used to provide supplementary angled edges. Additionally, the size of the supporting appendages is variable with each application.

In the present embodiment, each appendage is constructed with a generally solid panel foam material to create and support an approximately three-inch leading edge. Where the door panels are made with a vinyl, cloth, or other such material, the appendages may be sewn into the respective seals. Where the door panels are made from a wood, metal, or other such material, the appendages may be affixed by any type of glue, epoxy, or the like.

Figure 11:
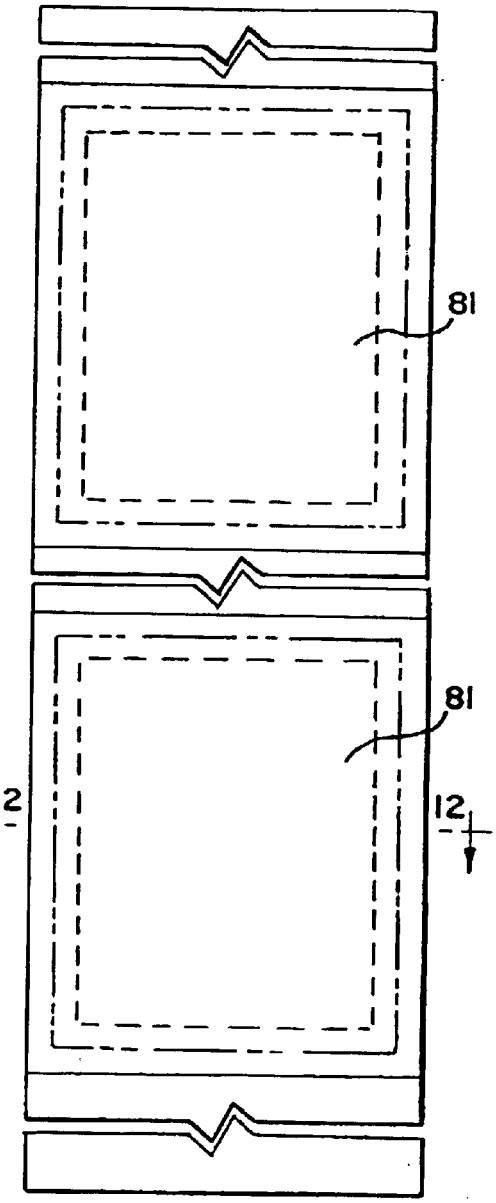
FIG. 11 is an elevated partial view of a magnet attracting plate PVC strip with two magnet attracting plates shown in broken lines.
Figure 14:
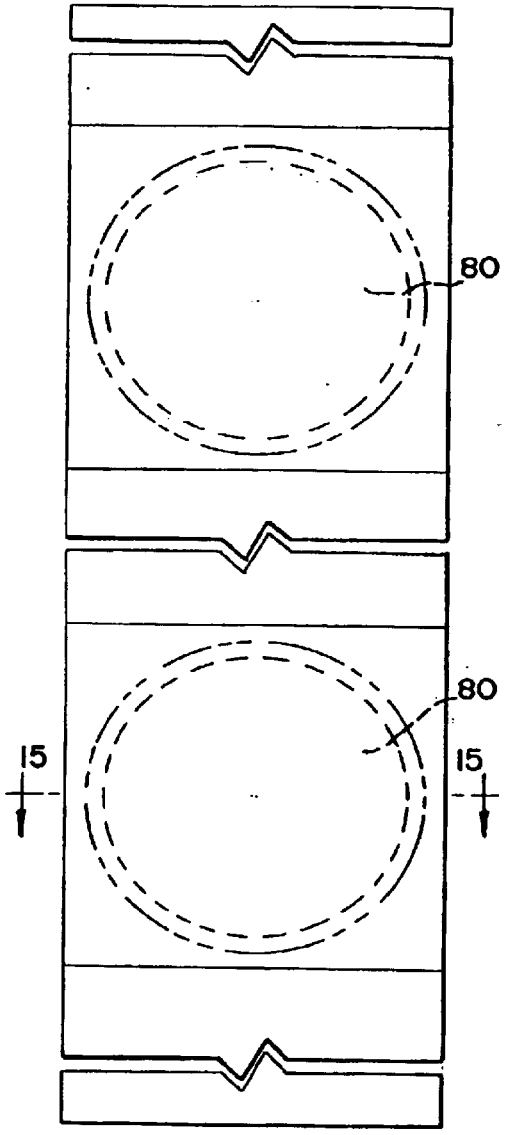
FIG. 14 is an elevated partial view of a magnet PVC strip with two magnets shown in broken lines.

To further facilitate the seal between door panel 15 and door panel 16, at least one magnet 80 (FIG. 14) may be located proximate to either seal 70 or 71, with at least one magnet attracter, such as a metal plate 81 (FIG. 11), being located proximate to the other edge. The magnet attracter is merely a material which will be affected by a magnetic field. Any ferromagnetic material, or substantially ferromagnetic material would be suitable. Alternatively, at least one magnet may be located proximate to both seals 70, 71, or a combination of alternating magnets and plates (oppositely paired between the panels).

Figure 10:
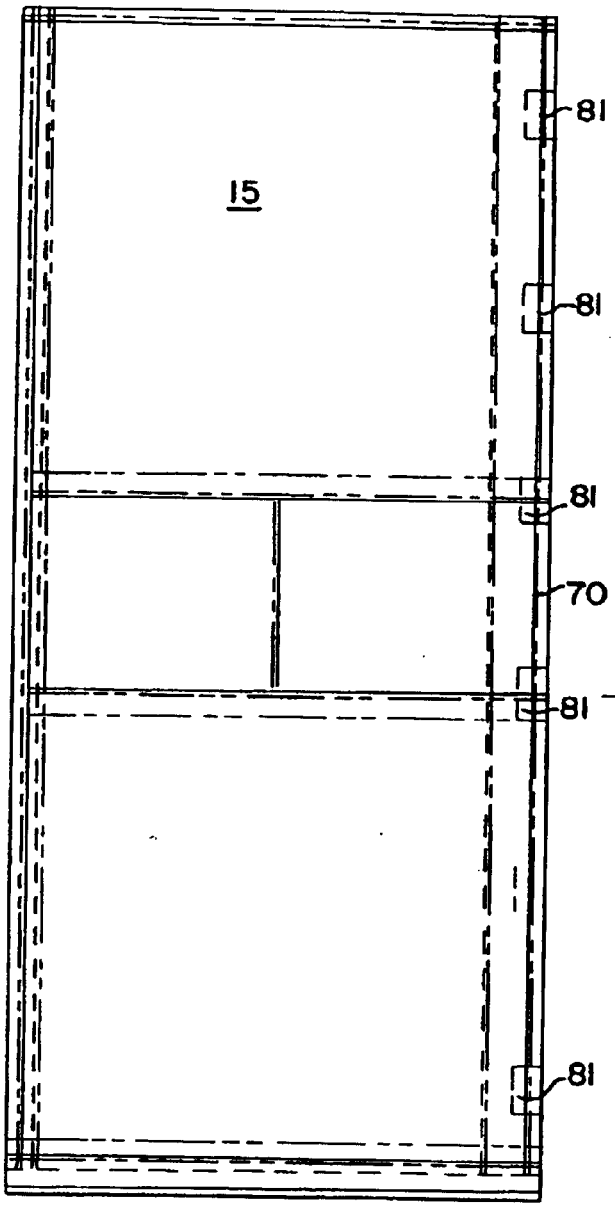
FIG. 10 is an elevated view of the left door panel.
Figure 12:
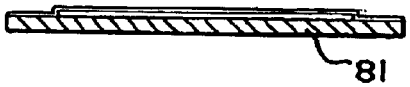
FIG. 12 is an elevated cross-section of the device of FIG. 11 taken along line 12—12 of FIG. 11.
Figure 13:
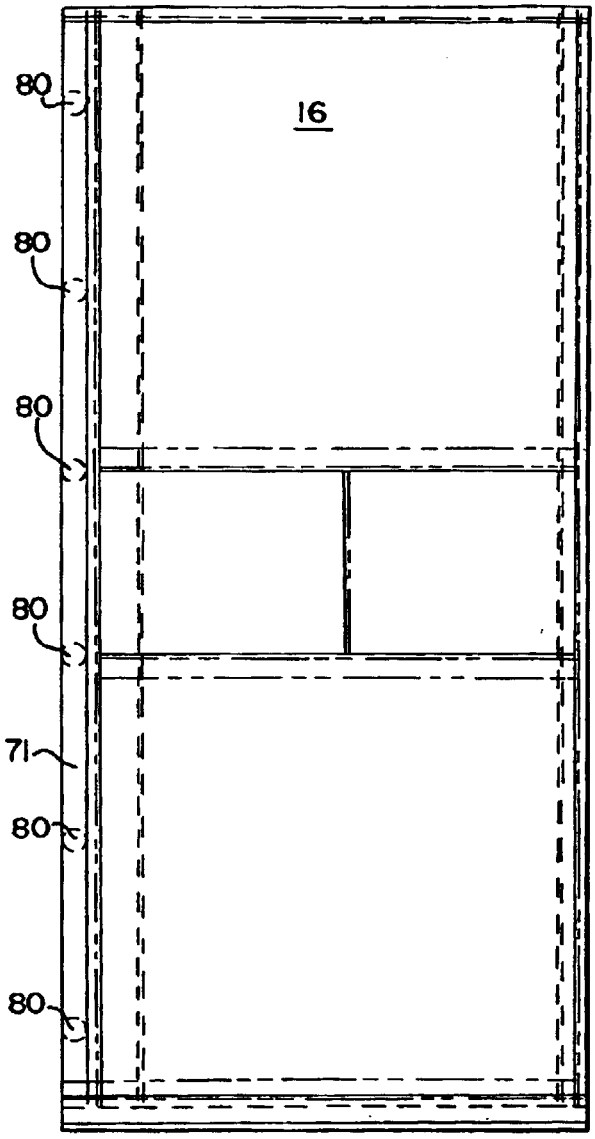
FIG. 13 is an elevated view of the right door panel.
Figure 15:
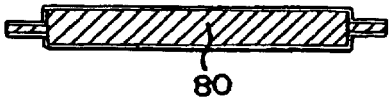
FIG. 15 is an elevated cross-section of the device of FIG. 14 taken along line 15—15 of FIG. 14.

Referring to FIGS. 10 and 13, it can be seen that several magnets 80 (six shown) and plates 81 are positioned along the vertical length of each seal 70, 71. To secure the magnets and plates in place, the present embodiment employs a suitable strip of ⅛ inch PVC with preformed pockets, as shown in FIGS. 12 and 15. The PVC strips are then attached to the seals 70, 71, insuring that magnets 80 and metal plates 81 align properly. Again, where the material is sewable, a lengthwise pocket may be created to hold the PVC strip. Otherwise, alternative attachment, via glue, epoxy, bolting, etc., may be necessary. Where magnets are to be used proximate to both seals 70, 71, multi-pole magnets may provide the greatest reliability. Matching up opposing poles is otherwise necessary.

The magnetic seal reduces the bounce of the door panels as they are brought together by holding seals 70 and 71 together. Additionally, this magnetic seal requires more force to break the seal; not enough to hinder the operation of drive motor 20 during opening, but a sufficient amount to require more than a strong air current in some cases. The use of more magnetic surfaces spaced along the leading edge of either or both doors panels will increase the strength of the seal.

As for trailing edges 72 and 73 (FIGS. 8 and 9) of the present invention, each carries a small protrusion 74 which serves as a catch to prevent further movement in the closing direction. FIG. 7 illustrates how protrusions 74 substantially abut a support beam when the door panels 15 and 16 are in a closed position. Protrusions 74, while shown to have triangular cross-sections, may be of any shape sufficient to act as a stop.

While specific embodiments have been illustrated and described, numerous modifications come to mind without significantly departing from the spirit of the invention, and the scope of protection is only limited by the scope of the accompanying claims.

We claim:

1. A door seal for use with bi-parting doors comprising:

at least one magnet located on a first sealing surface of a first seal, wherein the first seal is disposed proximate a leading edge of a first door panel, the door panel having a substantially linear opening and closing direction of travel; and at least one magnet attracter located on a second sealing surface of a second seal, wherein the second seal is disposed proximate a leading edge of a second door panel, the door panel having an opening and closing direction of travel aligned with and inverse to the opening and closing direction of travel of the leading edge of the first door panel, wherein the first sealing surface of the first door panel forms one of either an acute or obtuse angle with the plane of the door panel and the second sealing surface of the second door panel forms one of either an acute or obtuse angle with the plane of the door panel, the two angles being supplementary, wherein the first sealing surface of the first door panel overlaps the second sealing surface of the second door panel in a closed position, and wherein the magnet is configured to magnetically engage the magnet attracter when the bi-parting doors are in a closed position.

2. A door seal as in claim 1 wherein the first and second sealing surfaces have a mating geometry permitting an abutting force sufficient to magnetically engage at least one magnet attracter with at least one magnet when the door panels close.

3. A door seal as in claim 2 wherein the geometry of the first and second sealing surfaces also provide some overlapping extent when the doors are in a closed position.

4. A door panel as in claim 3 wherein the at least one magnet in each door panel is a multi-pole magnet.

5. A door panel as in claim 2 wherein the at least one magnet in each door panel is a multi-pole magnet.

6. A door panel as in claim 5 wherein the first door panel has a plurality of magnets spaced vertically proximate the leading edge of the first door panel.

7. A door seal as in claim 1 wherein the first seal has a triangular cross-section.

8. A door seal as in claim 1 wherein the second seal has a cross-section substantially similar to a parallelogram.

9. A door seal as in claim 1 further comprising an extension on a leading edge of the first door panel, and an extension on a leading edge of the second door panel.

10. A door seal an in claim 9 wherein the extension on the leading edge of the first door panel has a triangular cross section and the extension on the leading edge of the second door panel has a cross-section substantially similar to a parallelogram.

11. A door seal as in claim 1 wherein the second sealing surface comprises:

at least one pocket;

a strip of rigid material secured within the pocket; and at least one ferromagnetic plate attached to the rigid material.

12. A door seal as in claim 11 wherein the first sealing surface comprises:

at least one pocket;

a strip of rigid material secured within the pocket; and at least one magnet attached to the rigid material.

13. A door panel as in claim 1 wherein the at least one magnet in each door panel is a multi-pole magnet.

14. A door panel as in claim 13 wherein the first door panel has a plurality of magnets spaced vertically proximate the leading edge of the first door panel.

15. A door panel as in claim 1 wherein the first door panel has a plurality of magnets spaced vertically proximate the first scaling surface of the first door panel.

16. A door panel as in claim 15 wherein the first door panel has a plurality of magnets spaced vertically proximate the first sealing of the first door panel.

17. A door for at least partially covering a doorway defined by a wall and a lower surface, comprising:

a first door panel adapted to laterally translate along a plane relative to the doorway between a doorway blocking position and an unblocking position;

a first seal including a first sealing surface interposed between a first attachment end and a first distal end with the first attachment end being attached to the first door panel; and a second seal disposed to allow relative movement between the first seal and the second seal, the second seal including a second sealing surface interpose between a second attachment end and a second distal end, such that the first door in the doorway blocking position causes the first sealing surface to face the second sealing surface and positions the second distal end between the first distal end and at least one of the first door panel and the first attachment end, wherein both the first sealing surface and the second sealing surface are tilted relative to the plane.

* * * * *